United States Patent [19]

Gunn

[11] 4,192,561

[45] Mar. 11, 1980

[54] STORAGE CONTAINER FOR ROLL TISSUE PAPER

[76] Inventor: Joann Gunn, 32299 Susilane, Roseville, Mich. 48066

[21] Appl. No.: 908,813

[22] Filed: May 24, 1978

[51] Int. Cl.[2] ..... A47F 1/00; B65D 85/66

[52] U.S. Cl. ..... 312/42; 312/45; 312/206; 206/397

[58] Field of Search ..... 312/42, 45, 206; 242/55.3, 55.4; 211/13; 206/397, 394

[56] References Cited

U.S. PATENT DOCUMENTS

| | | | |
|---|---|---|---|
| 1,566,860 | 12/1925 | Hainzigianis | 312/206 |
| 1,712,080 | 5/1929 | Kelly | 312/42 |
| 1,913,231 | 6/1933 | Carlstedt et al. | 312/42 |
| 2,534,290 | 12/1950 | Moskowitz | 206/394 |
| 2,756,901 | 7/1956 | Cowsert | 312/42 |
| 3,104,923 | 9/1963 | Smith | 312/45 |
| 3,275,133 | 9/1966 | Wood | 312/42 |
| 3,727,748 | 4/1973 | Brown | 312/206 |
| 3,843,071 | 10/1974 | Graham | 206/397 |
| 4,008,933 | 2/1977 | Wanek | 312/42 |

*Primary Examiner*—Victor N. Sakran
*Attorney, Agent, or Firm*—Basile and Weintraub

[57] ABSTRACT pg,1 A portable storage container for storing tissue paper of the type rolled about a tubular core. The portable storage container comprises a tubular shaped housing having an interior diameter complementary to the size of the roll tissue paper and of a height sufficient to store a plurality of stacked rolls. The bottom of the housing is enclosed and supports a roll tissue paper holder in the form of a post having a circular base seated on the bottom of the housing. The holder post is sized to be received in the tubular cores of the rolls and to support a plurality of stacked rolls thereon such that a user may grasp the post and lift and remove the stacked rolls from the interior of the housing. The container includes a cover to enclose the same.

1 Claim, 4 Drawing Figures

STORAGE CONTAINER FOR ROLL TISSUE PAPER

BACKGROUND OF THE INVENTION

I. Field of the Invention

The present invention relates to portable storage containers for storing rolls of toilet paper and the like.

II. Description of the Prior Art

A number of paper product roll dispensers are known in the prior art, and it is generally known that such paper product roll dispensers include a spool for mounting on a rotatable spindle from which the product is unwound in desired lengths. Examples of such well-known products are disclosed in U.S. Pat. Nos. 3,539,124; 2,570,491; and 3,843,071.

It is also known that it is desirable to maintain extra rolls of tissue paper in or near the bathroom. In the past it has been necessary to store such extra rolls either in a closet near the bathroom or in the bathroom itself. However, if the tissue is stored in the bathroom, the extra rolls of tissue are generally placed in the medicine chest, a cabinet or, if no additional better place is available, on the water tank itself. In most situations the storage space is small and, thus, it is undesirable to store the tissue in these locations. Leaving the tissue on the water tank is unsightly and detracts from the overall decor of a bathroom. An example of an attempt to overcome the problems of the storage of toilet paper and the like is disclosed in U.S. Pat. No. 3,622,010.

Prior Art Statement

The aforementioned prior art, in the opinion of the applicant and applicant's attorneys, constitutes the most relevant prior art of which the applicant and applicant's attorneys are aware.

SUMMARY OF THE INVENTION

The present invention, which will be described subsequently in greater detail, comprises a portable storage container for storing tissue paper of the type rolled about a tubular core. The portable storage container comprises a tubular housing having an enclosed bottom and a removable cover. A paper holder in the form of a post attached to a circular base is so sized as to be received within the tubular cores of a plurality of stacked and aligned roll tissue paper such that the post may be lifted into and out of the container housing with the base of the holder supporting the rolls on the holder. The stacked tissue paper rolls may be removed and inserted from the container for use as desired and are enclosed within the container by means of the cover.

It is therefore a primary object of the present invention to provide a convenient place for the storage of a plurality of roll tissue paper within a bathroom in such a manner that the container does not upset the decor of the bathroom and does not occupy other usable space within the bathroom.

It is a further object of the present invention to provide a container for the storage of extra rolls of tissue in a bathroom wherein the rolls are concealed from view.

It is yet a further object of the present invention to provide such a container which is portable.

Other objects, advantages and applications of the present invention will become apparent to those skilled in the art of portable roll tissue paper containers when the accompanying description of one example of the best mode contemplated for practicing the invention is read in conjunction with the accompanying drawing.

BRIEF DESCRIPTION OF THE DRAWING

The description herein makes reference to the accompanying drawing wherein like reference numerals refer to like parts throughout the several views, and wherein.

DESCRIPTION OF THE PREFERRED EMBODIMENT

Figure 1:
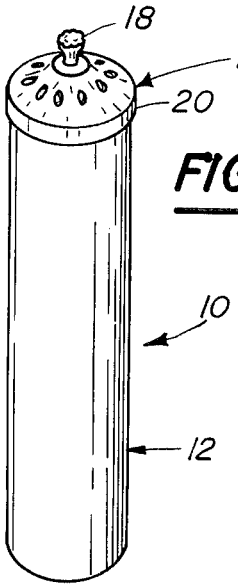
FIG. 1 is a perspective view of a portable storage container constructed in accordance with the principles of the present invention.

Referring now to the drawing and, in particular, to FIG. 1, there is illustrated one example of the present invention in the form of a portable storage container 10 comprising a housing 12 and a removably attached cover 14.

Figure 2:
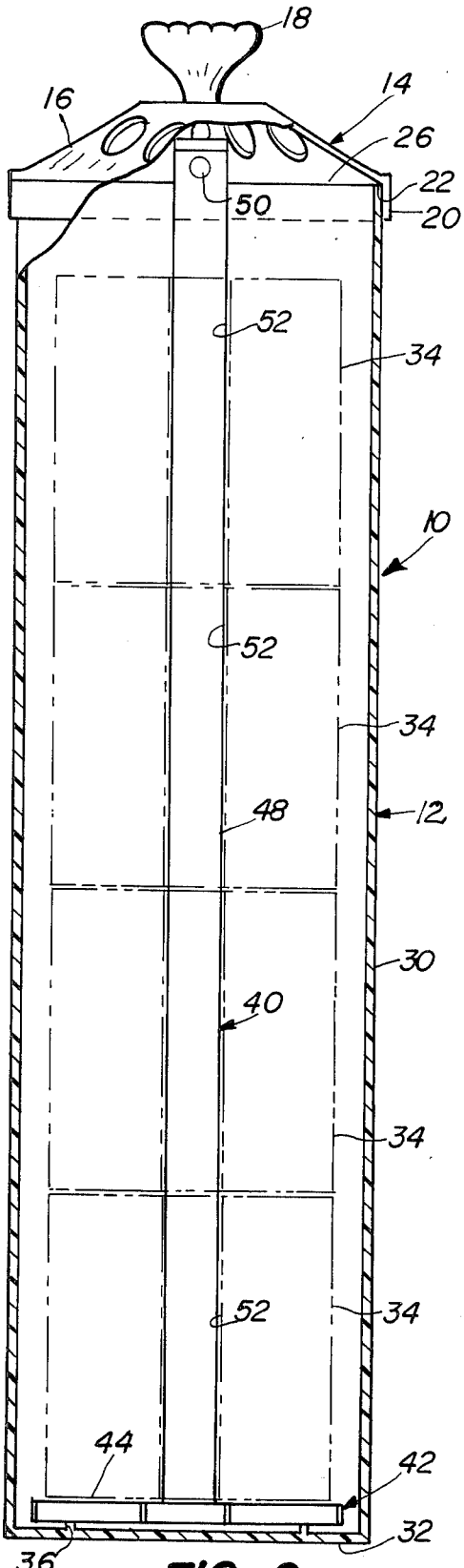
FIG. 2 is an enlarged, longitudinal, sectional view through the storage container illustrated in FIG. 1.

As can best be seen in FIG. 2, the cover 14 has a flattened, cone-shaped configuration indicated by the numeral 16 which terminates at its upper end in a knob 18 and at its lower end in a circular flange 20. The circular flange 20 securely receives the outer diameter of the housing 12, while the upper edge 26 of the housing 12 abuts a shoulder 22 formed on the inside surface of the circular flange 20. It can thus be seen that when it is desired, the cover 14 may be securely attached to the top of the housing 12 to enclose the same.

Still referring to FIG. 2, it can be seen that the housing 12 comprises a tubular wall 30 enclosed at its bottom by a bottom wall 32. Preferably, the housing 12 is fabricated from a unitary piece of material, such as plastic in a blow-mold process. The diameter of the tubular wall 30 is sized so as to receive therein a conventionally sized roll of toilet paper (four of which are indicated in phantom lines in FIG. 2 and designated by the numeral 34). The inside surface of the bottom wall 32 is provided with a circular raised ridge 36, for a purpose which will be described hereinafter.

Figure 3:
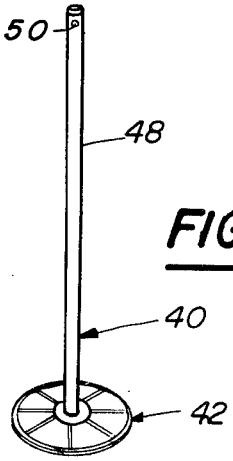
FIG. 3 is a perspective view of the roll tissue paper holder illustrated in FIG. 2 of the drawing.
Figure 4:
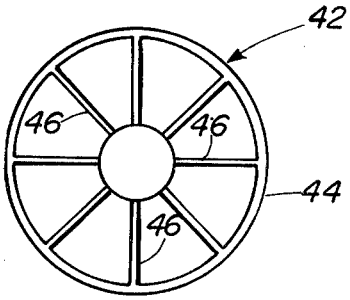
FIG. 4 is a bottom elevational view of the roll tissue paper holder illustrated in FIG. 3 of the drawing.

As can best be seen in FIGS. 2, 3 and 4, the portable storage container 10 further comprises a roll tissue paper holder 40. The holder 40 comprises a circular base 42 in the form of a spoked wheel having an outer rim member 44 (FIG. 4) and a plurality of supporting spokes 46 which are secured to the lower end of a post 48 which, in turn, extends upwardly and perpendicularly to the plane within which the base 42 is disposed. Preferably, the base 42 and the post 48 are fabricated from a suitable plastic material and are of a unitary, integral construction. The upper end of the post 48 is provided with an aperture 50, for a purpose which will be described hereinafter. The post 48 has a diameter which is sized to be loosely received within the tubular core 52 of each of the rolls 34 such that the rolls 34 may be stacked, one upon the other, in alignment around the holder post 48, with the bottom roll being supported by the upper surface of the base 42 and each successive roll 34 being supported by the roll beneath it. Preferably, the container housing 12 is of a height which is sufficient to permit the storage of four rolls there within. The base 42 is of a diameter sufficiently larger than the tubular core 52 to prevent its insertion therein and, preferably, of a diameter approximately corresponding to the outer diameter of the rolls 34. Obviously, the diameter of the base 42 should be less than the inner diameter of the tubular housing 12 so that the holder 40 with its base 42 and all the rolls 34 carried thereby may be simply raised and removed from the housing 12, as desired. The aperture 50 provides a simple means for the user to grasp the holder 40 and raise it along with the rolls 34 from within the housing 12.

The raised, circular ridge 36 functions to provide additional strength to the bottom of the container 10, as well as to hold the base 42 of the holder 40 above the bottom wall 32 of the container 10. The post 48 should be of a length sufficient to store four rolls thereon and to project above the top edge 26 of the housing 12 a sufficient distance such that the aperture 50 is exposed to permit the simple and easy grasping of the holder 40 by the user. When not in use, the container 10 may be positioned in an appropriate location in a bathroom where it will blend in with the decor of the bathroom, without exposing the stored toilet paper.

It can thus be seen that the present invention provides a new and improved portable and decorative toilet paper holder wherein it should be understood by those skilled in the art of such portable holders that other forms of applicant's invention may be had without departing from the spirit of the invention or scope of the appended claims.

What is claimed is as follows:

1. A portable storage container for storing roll tissue paper of the type rolled about a tubular core, said container comprising:

an upright housing having a circular side wall and a bottom wall enclosing the bottom of said housing;

a vertically raised circular ridge located on and integral with the inside surface of said bottom wall at a position radially, inwardly spaced from said circular side wall, said housing having an opening at its top which is sized to receive a roll of tissue paper;

a roll tissue paper holder having a post sized to be received in and extend through the tubular cores of said roll tissue paper;

a circular base made from a plastic material, said circular base being attached at its center to one end of said post, said base being sized larger than said tubular cores and smaller than said housing circular wall, said circular base comprising a central core section to which said post is attached, said core section having a plurality of radially extending spokes integral therewith and an outer ring member, the outer ends of said spokes being integrally connected to the inner surface of said ring member, said post being of a length to receive and support a plurality of stacked and aligned roll tissue paper, said holder being received within said container with said plurality of tissue being maintained in alignment by said post and supported by said holder base while said holder base is positioned above said housing bottom wall by the abutting engagement of the bottom of said spokes with said raised circular ridge, said post being of such a length as to extend above the housing top opening a sufficient distance to permit the user to grasp said post and remove same along with said tissue from said housing when said base is positioned on said housing bottom wall;

means at the top of said post for facilitating grasping the same; and a cover releasably attached to said container to enclose the top of said container.

* * * * *